US006971900B2

(12) United States Patent
Liebenow

(10) Patent No.: US 6,971,900 B2
(45) Date of Patent: Dec. 6, 2005

(54) CIRCUIT CARD RETAINING SYSTEM

(75) Inventor: Frank Liebenow, Jefferson, SD (US)

(73) Assignee: Gateway Inc., Irvine, CA (US)

( * ) Notice: Subject to any disclaimer, the term of this patent is extended or adjusted under 35 U.S.C. 154(b) by 15 days.

(21) Appl. No.: 10/785,538

(22) Filed: Feb. 24, 2004

(65) Prior Publication Data

US 2005/0186824 A1 Aug. 25, 2005

(51) Int. Cl.[7] ..... H01R 13/62
(52) U.S. Cl. ..... 439/327
(58) Field of Search ..... 439/327, 328, 439/357–358

(56) References Cited

U.S. PATENT DOCUMENTS 3,084,302 A * 4/1963 Braeutigam ..... 439/327
5,437,560 A * 8/1995 Mizuguchi ..... 439/326
5,515,240 A 5/1996 Rodeffer et al.
5,784,263 A 7/1998 Nelson
6,394,831 B1 5/2002 Bowers et al.
6,398,567 B1 * 6/2002 Nishimura ..... 439/159
6,824,407 B1 * 11/2004 Zhao et al. ..... 439/157
2001/0012716 A1 * 8/2001 Corisis et al. ..... 439/357

* cited by examiner

*Primary Examiner*—J. F. Duverne
(74) *Attorney, Agent, or Firm*—Jeffrey A. Proehl; Leonard & Proehl, Prof LLC; Frank Liebenow

(57) ABSTRACT

An add-on circuit card retention apparatus is disclosed that includes an add-on circuit card defining a reference plane and having a first connector, a second circuit card having a second connector for mating with the first connector, and a clip assembly for releasably securing the add-on circuit card to the second circuit card. The clip assembly includes a first catch member located on the add-on circuit card and a second catch member being located on the second connector. The first catch member has a first catch surface generally lying in a plane forming a first catch member angle with respect to the reference plane of less than 90 degrees. The second catch member has a second catch surface generally lying in a plane forming a second catch member angle with respect to the reference plane of less than 90 degrees when the first connector of the add-on circuit card is in a mated condition with the second connector.

23 Claims, 2 Drawing Sheets

CIRCUIT CARD RETAINING SYSTEM

FIELD OF THE INVENTION

The present invention generally relates to the field of circuit card retention where a printed circuit card is inserted into a connector and is retained by a secondary component which impedes inadvertent disengagement of the card, or the like.

BACKGROUND OF THE INVENTION

Printed circuit cards with edge connectors or other forms of connectors are widely used in many electronic products. These cards may be used to configure additional capability to an otherwise standard system. For example, in many Personal Computer (PC) systems, various card standards exist to allow the manufacturer or end user to add features and capabilities to the computer. These standards include, but are not limited to, PCI (Personal Computer Interconnect) cards, ISA (Industry Standard Adapter) cards, Micro-Channel cards, Card Bus cards, PCMCIA cards and newer standards, such as 3GIO ($3^{rd}$ Generation I/O) cards. Some of these cards have connectors mounted on the edge that mates with a connector on a different printed circuit card within the PC. Some of these cards have contacts, called fingers, on their edge, collectively called edge connectors. These cards insert into connectors mounted on another printed circuit card within the system or PC, such as a motherboard.

In general, these upgrade cards are sometimes held in place by a bracket at one end of the card. Usually, this bracket is the same bracket that additionally has connectors to interface with external components. For example, if the upgrade card is a Video Graphics Card, then the bracket may contain a graphics port, possibly utilizing the Video Graphics Adapter (VGA) standard. Even with this bracket and the use of a screw, there exists an industry problem whereas these upgrade cards become unseated from the connector on the second printed circuit card causing systems to malfunction or to not operate. Shock and vibration can cause the upgrade card to at least partially lift out of the connector and lose contact on one or more of its fingers. A prevalent symptom of this happening are PC systems that fail when delivered to customers due to shipping shock vibration, exhibiting symptoms such as "no-video" when the graphics adapter becomes loose or "no-modem" when the modem becomes loose.

In the prior art, several attempts have been made to hold the upgrade cards in place, especially during shipping. Some attempts include a strap passing over the card, and positioning a stop material on the equipment cover that pushes down on the card to keep it in place.

Another approach has been to employ a rigid clip that attempts to lock the card to the connector that it is inserted into. One example of such a rigid clip system 100 is depicted in FIG. 1 of the drawings, which shows an adapter card 110 with a rigid clip assembly 140, 150 and 160. The rigid clip assembly 140, 150 and 160 consists of three components: a support member 140; a riser member 150, and a connector interface member 160. The support member 140 is affixed to the adapter card 110. When the adapter card is fully mated with connector 120, the interface member 160 of the rigid clip assembly engages a lip 130 of a connector 120 into which the adapter card is inserted, and shouldn't easily separate from connector 120 when shock or vibration occurs. The connection interface member 160 and the lip 130 each have a contacting surface, and the contacting surfaces of the respective parts contact each other when the interface member 160 engages the lip 130. Each of the contacting surfaces lies in a plane that is oriented perpendicular to the surface of the adapter card 110, so that simple lateral movement of the interface member 160 with respect to the lip 130 releases the member 160 from the lip 130 and the adapter card 110 is free to move out of the connector 120.

This known clip structure is somewhat effective in reducing the likelihood that the adapter card 110 will become inadvertently dislodged from the connector 120. However, since simple lateral movement of a lower portion of the riser member 150 that carries the interface member 160 can release the member 160 from the lip 130 (which can result simply from flexing of the support member 140), there is still an appreciable chance that jostling during shipping or other movement of the PC will result in the adapter card 110 being dislodged from the connector 120.

The present invention is an improvement upon the latter structure that provides greater resistance to inadvertent release of the adapter card from the connector.

SUMMARY OF THE INVENTION

The present invention is directed to a clip assembly that is attached to the upgrade or option card, whereas the clip assembly is coupled to the same connector that the upgrade or option card is inserted into and whereas the clip assembly holds the upgrade or option card in place, and impedes the upgrade or option card from moving out of the connector when shock and vibration occur, while still being releasable by finger pressure applied to the appropriate location on the clip assembly.

The prior art structures rely upon friction alone between the clip assembly and a lip formed on the connector to hold the card in place Since both the clip assembly and the lip are often made from plastic, the amount of friction present therebetween is usually minimal, and this often allows the clip assembly to slip out of engagement with the lip under certain shock or vibration scenarios. The present invention improves upon the prior art by incorporating an angled first catch surface at the point where the clip assembly engages an angled second catch surface on the connector so that the clip assembly is engaged with the connector, and in turn the upgrade or option card on which the clip assembly is mounted is more effectively held in engagement with the connector.

It is to be understood that both the foregoing general description and the following detailed description are exemplary only and are not restrictive of the invention as claimed. The general functions of this invention may be combined in different ways to provide the same functionality while still remaining within the scope of this invention. Various combinations of connectors and upgrade cards may be used without veering from the intent of this invention. Throughout this description, the term upgrade card is used to represent a printed circuit card that has a connector or fingers that mate with a connector or fingers on a different printed circuit card. This type of card is known to one skilled in the art as an option card, a daughter card, an option card, an upgrade card, or the like. Likewise, the printed circuit that has a connector or fingers that the upgrade card plugs into may be known as a "motherboard," but this invention is not limited by this.

BRIEF DESCRIPTION OF THE DRAWINGS

The numerous advantages of the present invention may be better understood by those skilled in the art by reference to the accompanying figures in which.

DETAILED DESCRIPTION

Reference will now be made in detail to the presently discussed embodiment of the invention, an example of which is illustrated in the accompanying drawing.

Figure 1:
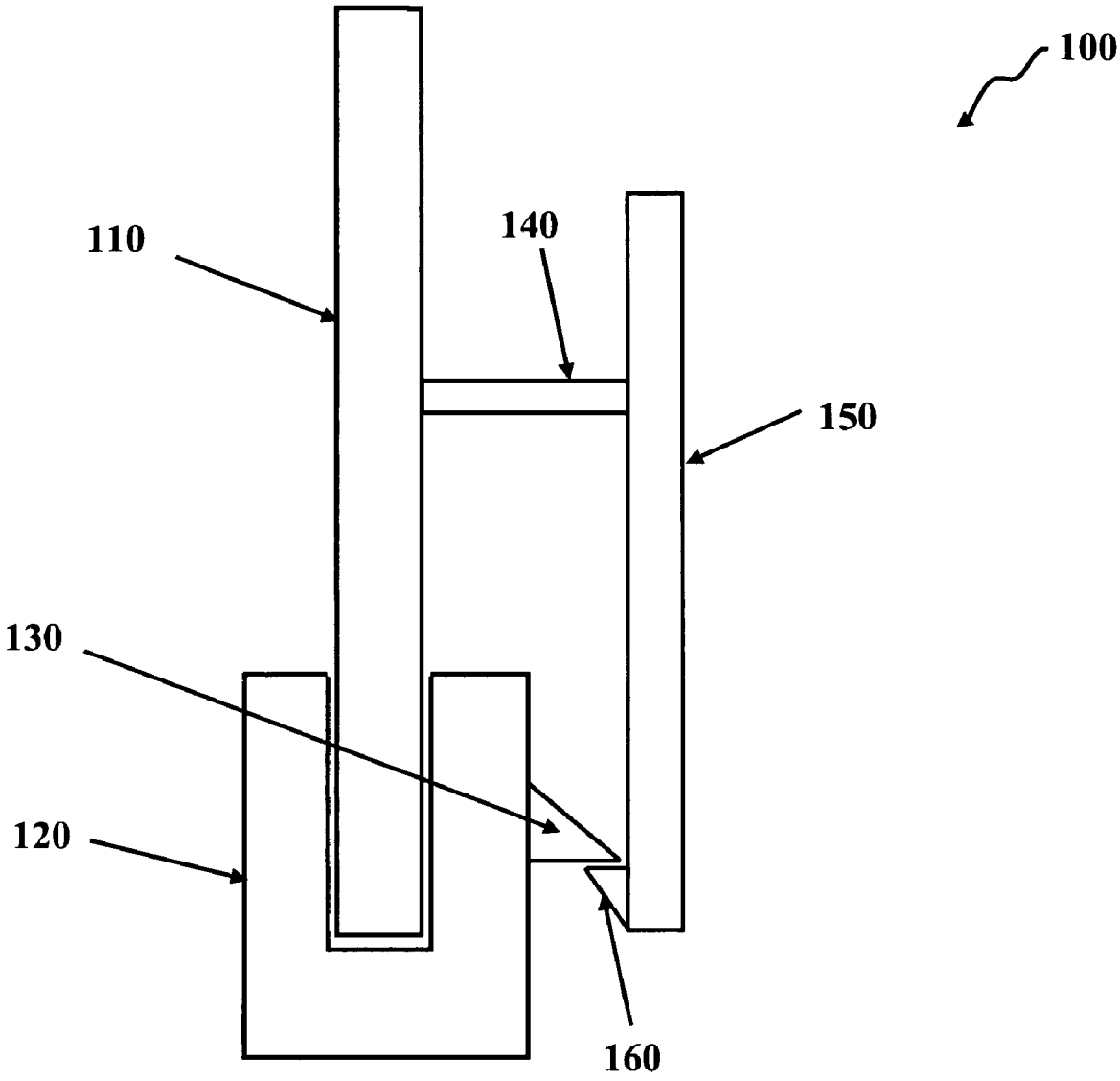
(Prior Art) FIG. 1
FIG. 1 shows a side view of the prior art.
Figure 2:
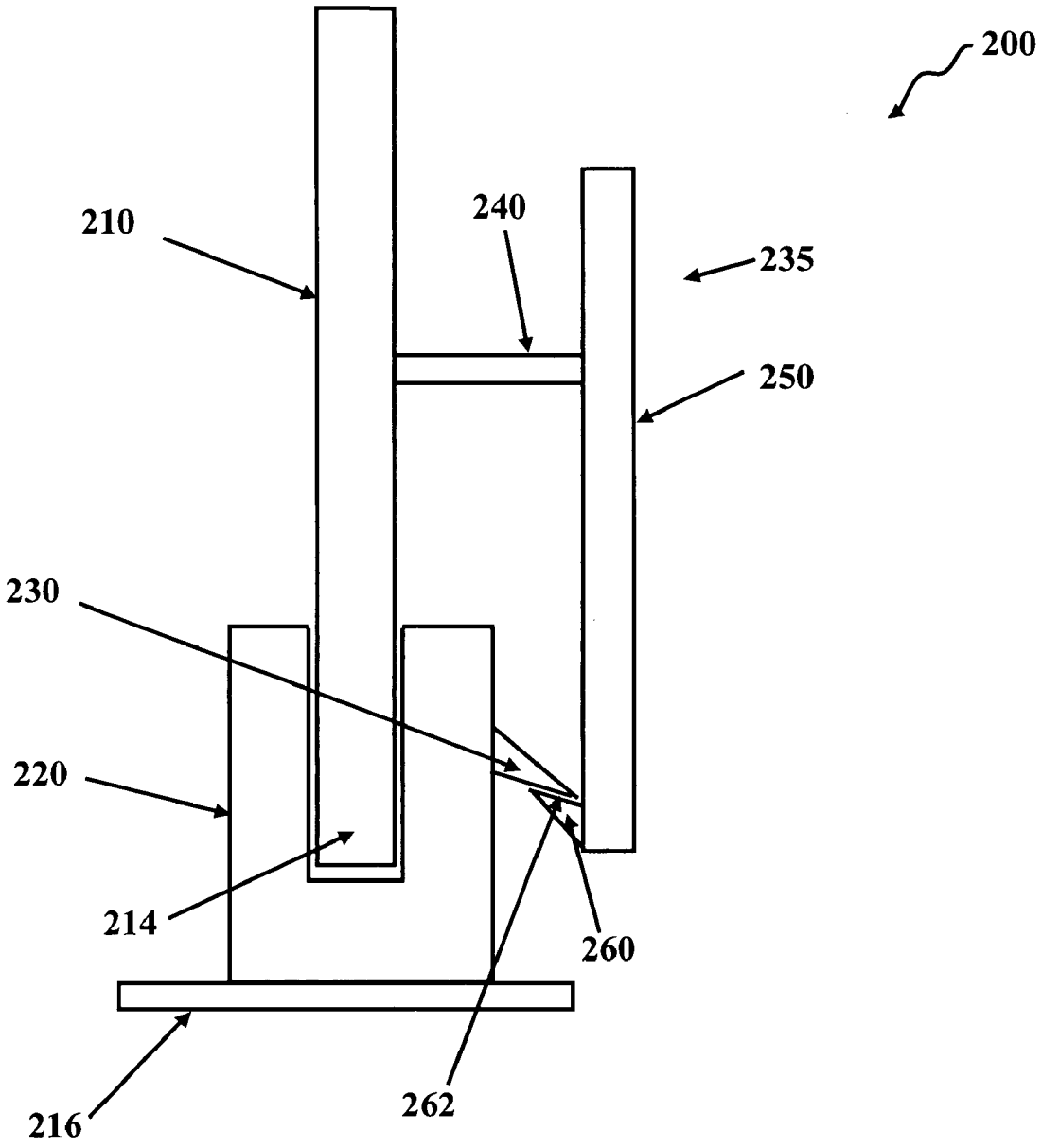
FIG. 2 shows a side view of an adapter card according to the present invention with the improved rigid clip.

Referring now to FIG. 2, a retaining system 200 in accordance with the present invention is shown. The retaining system 200 may be implemented on a first circuit card, which may be described as an add-on, or an adapter, card 210. The adapter card 210 typically includes a surface or face 212 that may generally define a reference plane. The adapter card 210 typically has an edge portion or region that forms a first connector 214, and this first connector portion of the card 210 may be provided with a plurality of electrical contacts. A second circuit card 216, which in some embodiments of the invention forms a motherboard of a computer, includes a second connector 220. The first connector 214 of the adapter card 210 may be mated with the second connector 220 by inserting the first connector 214 into a slot formed in the second connector 220 in a movement that is generally parallel to the reference plane.

The retaining system 200 includes a substantially rigid clip assembly 235. The clip assembly 235 may include three components: a support member 240, a riser member 250, and a first catch member 260. Optionally, all three components of the clip assembly 235 may be molded as one piece from the same material, or may be separate components that are bonded together. The support member 240 of the clip assembly 235 is affixed to the adapter card 210. The support member 240 may be attached by adhesive, glue, rivet, screw or any means known to the industry.

The second connector 220 on the second circuit card 216 has a second catch member 230 that engages with the first catch member 260 of the clip assembly 235 when the first connector 214 is fully seated in the second connector 220. The second catch member 230 may extend along, and generally parallel to, a length of the second connector 220.

In a significant aspect of the invention, the first catch member 260 has a first catch surface 262 that is oriented at a first catch member angle that may be measured with respect to various structures, including with respect to the reference plane of the adapter card 210 or with respect to an extent of the riser member 250. While the reference plane of the adapter card 210 and the riser member 250 may often be substantially parallel, the first catch member angle as referred to herein will be made in reference to the reference plane of the adapter card 210, or a plane oriented parallel to the reference plane which would result in the same relative angle measurement.

In exemplary embodiments of the invention, the first catch member angle is an interior angle of less than 90 degrees. The first catch member angle may be different than that depicted in FIG. 2. The first catch member angle may be relatively large, for example, 89 to 85 degrees, or it may be anywhere in the range of slightly less than 90 degrees to as little as 70 degrees. Some exemplary ranges for the first catch member angle: 89 degrees to 85 degrees; 85 degrees to 80 degrees and 80 degrees to 75 degrees. In some instances, the present invention may be configured with the first catch member angle measuring less than 70 degrees to help prevent the adapter card 210 from separating from its connectors due to extreme shock or vibration.

In another significant aspect of the invention, the second catch member 230 has a second catch surface 232 that is oriented at a second catch member angle with respect to the reference plane of the face 212 of the adapter card 210. The second catch surface 232 is thus positioned such that when engaged with the first catch surface, the first catch member 260 cannot easily slide off of the second catch member 230 merely by overcoming any friction between the catch surfaces 232, 262. The second catch member angle associated with the second catch member 230 may be substantially the same as the first catch member angle of the first catch member 260 so that the orientations of the surfaces 232, 262 are complementary. Optionally, the second catch member angle of the second catch surface 232 may be slightly less than the first catch member angle of the first catch surface 262 to promote a better grip between the second catch member 230 and the first catch member 260.

Once the first connector 214 of the adapter card 210 is sufficiently inserted into the second connector 220 (such as, for example, to achieve electrical communication between the contacts of the first and second connectors), the first catch member 260 rests next to the second catch member 230 of the second connector 220. During the installation process, placing slight downward pressure on the riser member 250 causes the support member 240 to flex slightly, allowing the leading edge of the first catch member 260 to pass beyond the leading edge of the second catch member 230 and mate appropriately. Once in this position, the first catch member 260 doesn't easily separate from the second catch member 230 when shock or vibrations occur.

Significantly, the orientation of the first catch surface 262 at a first catch member angle of less than 90 degrees and the second catch surface 232 at a second catch member angle of less than 90 degrees generally creates a hooked (and generally interlocked) relationship or condition therebetween when the first catch member 260 and the second catch member 230 are engaged with each other and the first connector 214 is fully seated in the second connector 220. This hooked or interlocked condition of the first catch member 260 and the second catch member 230 is not undone simply by lateral outward movement of the first catch member 260 with respect to the second catch member 230, such as might easily occur during jostling experienced by the computer during shipping. To undo the hooked condition of the first catch member 260 and the second catch member 230 requires that the first catch member 260 not only move laterally outward from the second catch member 230, but also in the general direction of the second connector 220 and generally toward the motherboard 216 on which the second connector 220 is typically mounted. In this way, the shape of the first catch member 260 and the second catch member 230 (and the respective orientations of the first 262 and second 232 catch surfaces) may actually force the riser member 250 to also move toward the second connector 220, as well as, depending upon the rigidity of the support member 240, the adapter card 210 itself. Thus, dislodging of the second catch member 260 from the first catch member 260 may require that the first connector 214 of the adapter card 210 itself move deeper into the slot of the second connector 220. As a result, accidental dislodgement of the first connector 214 of the adapter card 210 from the second connector 220 is made more difficult, and less likely. Moreover, movement of the adapter card 210 outwardly from the second connector 220 actually increases or intensifies the hooked relationship between the first catch member 260 and the second catch member 230, leaving the first 260 and second 230 catch members more strongly engaged.

The second catch member 230 can be made of the same material as the case of the second connector 220, or it may be fabricated separately and affixed in various ways including an adhesive or bonding agent. The support member 240 may be fabricated of a material such as plastic or metal that is somewhat flexible yet after releasing pressure, restores to substantially its original shape, thereby allowing pressure to be exerted to engage the catch and after pressure is released, the first catch member 260 raises so that it fully engages with the second catch member 230.

Although the invention has been described with a certain degree of particularity, it should be recognized that elements thereof may be altered by persons skilled in the art without departing from the spirit and scope of the invention. It is believed that the improved circuit card retaining system of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof, and further without providing substantial change thereto. It is the intention of the claims to encompass and include such changes.

What is claimed is:

1. An add-on circuit card retention apparatus comprising:

an add-on circuit card having a face generally defining a reference plane, said add-on circuit card having a first connector;

a second circuit card having a second connector for mating with said first connector to provide electrical contact between said add-on circuit card and said second circuit card;

a clip assembly for releasably securing said add-on circuit card to said second circuit card, said clip assembly comprising:

a first catch member located on said add-on circuit card and extending towards said second connector, said first catch member having a first catch surface, said first catch surface generally lying in a plane forming a first catch member angle with respect to said reference plane of less than 90 degrees; and a second catch member being located on said second connector and extending along said second connector, said second catch member having a second catch surface extending away from said second connector, said second catch surface generally lying in a plane forming a second catch member angle with respect to said reference plane of less than 90 degrees when said first connector of said add-on circuit card is in a mated condition with said second connector.

2. An add-on circuit card retention apparatus according to claim 1, wherein said clip assembly further includes a first member extending from said add-on circuit card and a second member extending from said first member to a position near said second connector when said first connector of said add-on circuit card is mated with said second connector of said second circuit card, said first catch member being mounted on said second member.

3. An add-on circuit card retention apparatus according to claim 1, wherein said first catch member angle measures between 89 degrees and 70 degrees.

4. An add-on circuit card retention apparatus according to claim 1, wherein said second catch member angle measures between 89 degrees and 70 degrees.

5. An add-on circuit card retention apparatus according to claim 1, wherein said first catch member angle is substantially equal to said second catch member angle.

6. An add-on circuit card retention apparatus according to claim 1, wherein said second connector has a side, and said second catch member is located on said side of said second connector.

7. An add-on circuit card retention apparatus according to claim 1, wherein said clip assembly is substantially rigid.

8. An add-on circuit card retention apparatus according to claim 1, wherein said second circuit card is a personal computer motherboard.

9. An add-on circuit card retention apparatus according to claim 1, wherein said first connector is a printed circuit card edge connector and said second connector conforms to the Personal Computer Interconnect (PCI) standard.

10. An add-on circuit card retention apparatus according to claim 1, wherein said first connector is a printed circuit card edge connector and said second connector conforms to the Industry Standard Adapter (ISA) standard.

11. An add-on circuit card retention apparatus according to claim 1, wherein said first connector is a printed circuit card edge connector and said second connector conforms to the next generation interconnect standard known as 3GIO.

12. An add-on circuit card retention apparatus according to claim 1, wherein said first catch member extends outwardly from the face of said add-on circuit card, and wherein said second connector has a side corresponding to the face of said add-on circuit card when said first connector of said add-on circuit card is mated with said second connector of said second circuit card, said second catch member being located on said side of said second connector.

13. An add-on circuit card retention apparatus according to claim 1, wherein said clip assembly further includes a first member extending from said add-on circuit card and a second member extending from said first member to a position near said second connector when said first connector of said add-on circuit card is mated with said second connector of said second circuit card, said first catch member being mounted on said second member in a manner such that said first member forms a fulcrum for said second member and such that application of force to a portion of said second member tends to move said first catch member out of engagement with said second catch member when said first connector of said add-on circuit card is mated with said second connector of said second circuit card.

14. A method for securing an add-on circuit card with a first connector in a mated relationship with a second connector, said add-on circuit card having a clip assembly, said clip assembly including a first catch member with a first catch surface thereon mounted on said add-on circuit card and a second catch member with a second catch surface formed thereon on said second connector, said first catch surface being oriented at an acute angle with respect to a face of said add-on circuit card and said second catch surface being oriented at an acute angle with respect to said face of said add-on circuit card when said connectors are in a mater condition, comprising:

inserting said first connector of said add-on circuit card into said second connector;

seating said first connector of said add-on circuit card fully into said second connector;

exerting pressure on said clip assembly such that said first catch member of said clip assembly extends just past said second catch member of said second connector;

maneuvering said first catch surface of said first catch member so that said first catch surface aligns with said second catch surface of said second catch member of said second connector; and releasing pressure on said clip assembly such that said first catch surface of said first catch member on said first connector contacts said second catch surface of said second catch member on said second connector to thereby retain said first connector in said second connector.

15. A method according to claim 14, wherein said second connector is mounted on a second circuit board, and said second circuit board comprises a personal computer motherboard.

16. A method according to claim 14, wherein said first connector is a printed circuit card edge connector and said second connector conforms to the Personal Computer Interconnect (PCI) standard.

17. A method according to claim 14, wherein said first connector is a printed circuit card edge connector and said second connector conforms to the Industry Standard Adapter (ISA) standard.

18. A method according to claim 14, wherein said first connector is a printed circuit card edge connector and said second connector conforms to the next generation interconnect standard known as 3GIO.

19. A method according to claim 14, whereas said clip assembly is fastened to said add-on circuit card by an adhesive.

20. A method according to claim 14, whereas said clip assembly is fastened to said add-on circuit card by welding.

21. A method according to claim 14, whereas said clip assembly is fastened to said add-on circuit card by a fastener.

22. A method according to claim 14, wherein said first catch surface has substantially the same angle as said second catch surface.

23. An add-on circuit card retention apparatus according to claim 1, wherein said second catch member angle is slightly less than said first catch member angle.

* * * * *